US011130350B2

(12) United States Patent
Nozawa

(10) Patent No.: US 11,130,350 B2
(45) Date of Patent: Sep. 28, 2021

(54) APPLICATION APPARATUS AND IMAGE FORMING SYSTEM INCORPORATING SAME

(71) Applicant: Kenji Nozawa, Kanagawa (JP)

(72) Inventor: Kenji Nozawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/712,658

(22) Filed: Dec. 12, 2019

(65) Prior Publication Data

US 2020/0238725 A1 Jul. 30, 2020

(30) Foreign Application Priority Data

Jan. 24, 2019 (JP) ..... JP2019-010597

(51) Int. Cl.

| | |
|---|---|
| ***B41J 11/00*** | (2006.01) |
| ***B41J 2/21*** | (2006.01) |
| ***B05C 1/08*** | (2006.01) |
| *B41M 5/00* | (2006.01) |

(52) U.S. Cl.

CPC ..... *B41J 2/2114* (2013.01); *B05C 1/08* (2013.01); *B41J 2202/02* (2013.01); *B41M 5/0017* (2013.01)

(58) Field of Classification Search

CPC ... B41J 11/0015; B41J 2/2114; B41M 5/0011; B41M 5/001

See application file for complete search history.

(56) References Cited

U.S. PATENT DOCUMENTS

2008/0121126 A1* 5/2008 Takahashi ..... B41L 13/08 101/231
2010/0053239 A1* 3/2010 Furukawa ..... B41J 11/0015 347/6
2012/0275834 A1* 11/2012 Naitoh ..... G03G 15/2053 399/329
2013/0070017 A1* 3/2013 Fujii ..... B41M 5/0011 347/20
2013/0249995 A1* 9/2013 Furukawa ..... B41J 2/01 347/21
2014/0253652 A1* 9/2014 Ohba ..... B41J 11/0015 347/101

(Continued)

FOREIGN PATENT DOCUMENTS

JP 2011-183336 9/2011
JP 2013-091261 5/2013

(Continued)

*Primary Examiner* — Scott A Richmond
(74) *Attorney, Agent, or Firm* — Duft & Bornsen, PC

(57) ABSTRACT

An application apparatus includes a first roller configured to apply a treatment liquid to a recording medium conveyed; and a second roller disposed in contact with the first roller and forming, with the first roller, a conveyance nip in which the recording medium is nipped. The application apparatus further includes a third roller disposed in contact with the first roller at a position different from the conveyance nip, and a fourth roller disposed in contact with the second roller at a position different from the conveyance nip. The third roller has a rigidity higher than a rigidity of the first roller, and the fourth roller has rigidity higher than a rigidity of the second roller.

17 Claims, 5 Drawing Sheets

(56) References Cited

U.S. PATENT DOCUMENTS

| | | | | |
|---|---|---|---|---|
| 2015/0283829 | A1* | 10/2015 | Gazit | B41J 23/08 347/9 |
| 2016/0059586 | A1 | 3/2016 | Numata et al. | |
| 2019/0283069 | A1 | 9/2019 | Nakagaki et al. | |

FOREIGN PATENT DOCUMENTS

| | | |
|---|---|---|
| JP | 2014-113750 | 6/2014 |
| JP | 2015-214080 | 12/2015 |
| JP | 2016-052740 | 4/2016 |

* cited by examiner

APPLICATION APPARATUS AND IMAGE FORMING SYSTEM INCORPORATING SAME

CROSS-REFERENCE TO RELATED APPLICATION

This patent application is based on and claims priority pursuant to 35 U.S.C. § 119(a) to Japanese Patent Application No. 2019-010597, filed on Jan. 24, 2019, in the Japan Patent Office, the entire disclosure of which is hereby incorporated by reference herein.

BACKGROUND

Technical Field

This disclosure relates to an application apparatus and an image forming system incorporating the application apparatus.

Description of the Related Art

An application apparatus that applies a treatment liquid onto a surface of a recording medium is known. There is also known an image forming system in which such an application apparatus is combined with an image forming apparatus that forms an image on a recording medium coated with the treatment liquid. The treatment liquid makes the surface of the recording medium suitable for image formation.

An example of the application apparatus is a pre-treatment apparatus for an inkjet image forming apparatus. For example, the pretreatment apparatus includes a draw-up roller to pump up a predetermined amount of treatment liquid from a supply pan in which treatment liquid is stored, and an application roller to receive the treatment liquid from the draw-up roller and apply the treatment liquid to a recording medium.

SUMMARY

According to an embodiment of this disclosure, an application apparatus includes a first roller configured to apply a treatment liquid to a recording medium conveyed; and a second roller disposed in contact with the first roller and forming, with the first roller, a conveyance nip in which the recording medium is nipped. The application apparatus further includes a third roller disposed in contact with the first roller at a position different from the conveyance nip, and a fourth roller disposed in contact with the second roller at a position different from the conveyance nip. The third roller has a rigidity higher than a rigidity of the first roller, and the fourth roller has rigidity higher than a rigidity of the second roller.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
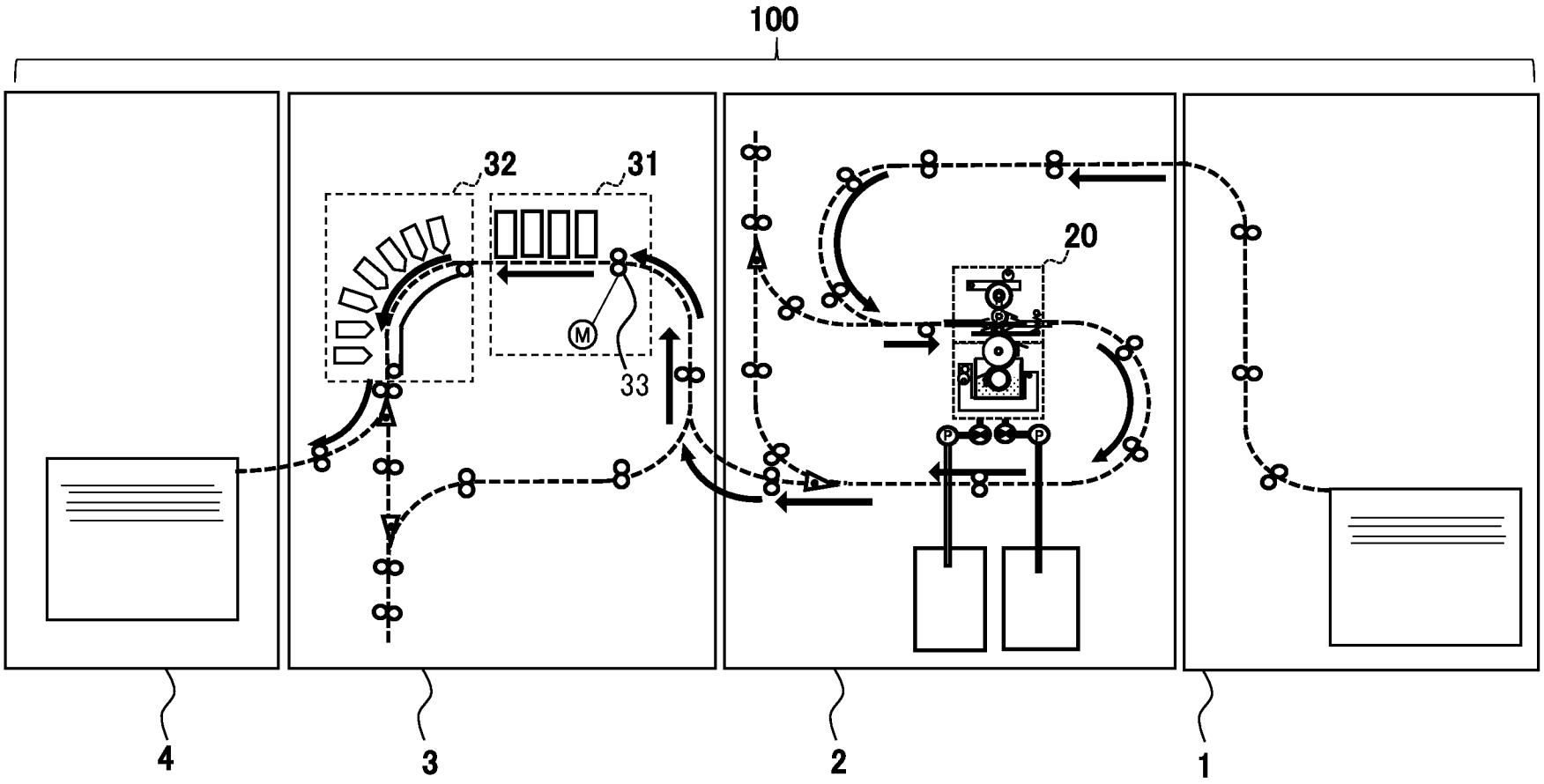
FIG. 1 is a view illustrating a configuration of an image forming system according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The embodiments described below relate to an application apparatus that applies a treatment liquid acting on an image forming material (ink) onto an image formation surface of a recording medium.

The inventor recognizes an inconvenience when a cut sheet as a recording medium is processed in an application apparatus that applies a treatment liquid to the cut sheet. That is, after passing through the position (a nip between a draw-up roller and an application roller) where the treatment liquid is applied to the recording medium, a leading end of the recording medium easily sags. The leading end here represents a downstream end of the recording medium in the direction of conveyance of the recording medium. As a result, the recording medium coated with the treatment liquid winds around the application roller after passing through the nip, and the recording medium is easily jammed. Therefore, a countermeasure is taken to prevent the in the application apparatus.

As an approach to prevent the winding, around the application roller, of the recording medium coated with the treatment liquid, the application roller may be reduced in diameter. As the diameter of the application roller is reduced (the radius of curvature decreases), the curvature at the surface of the application roller is increased. Accordingly, the leading end of the recording medium is easily peeled off from the application roller while conveyed downstream.

However, if the diameter of the application roller is reduced, the application roller is likely to deflect. When the application roller deflects, the amount of treatment liquid transferred from the draw-up roller to the application roller does not become the target amount, and the amount of treatment liquid applied to the recording medium by the application roller becomes uneven.

When the treatment liquid becomes uneven, the surface of the recording medium on which image formation is performed is not uniform, which may adversely affect the quality of image formation.

According to an embodiment of the present disclosure, an application apparatus provides the following effect. After a recording medium, especially a cut sheet, passes through a structure to apply a treatment liquid to the recording medium, the recording medium does not remain on (e.g., wind around) the structure in a state where the recording media is not subjected to any external force that retains the conveyed posture thereof. One aspect of the present disclosure is that the application roller to apply the treatment liquid is shaped to inhibit winding of the recording medium after application of the treatment liquid thereto, and that uneven application of the treatment liquid is inhibited.

Referring now to the drawings, wherein like reference numerals designate identical or corresponding parts throughout the several views thereof, and particularly to FIG. 1, an image forming system according to an embodiment of this disclosure is described. As used herein, the singular forms "a", "an", and "the" are intended to include the plural forms as well, unless the context clearly indicates otherwise.

[Image Forming System]

First, a description is given of a configuration of an image forming system according to an embodiment of the present disclosure. FIG. 1 is a schematic view illustrating an outline of a printing system 100 as an embodiment of an image forming system. As illustrated in FIG. 1, the printing system 100 includes a sheet feeder 1, a treatment liquid application apparatus 2 as an example of the application apparatus, a printer 3 as an example of an image forming apparatus, and a medium ejection device 4. Note that the treatment liquid application apparatus 2 and the printer 3 can be combined as an image forming apparatus as an embodiment of the present disclosure.

The sheet feeder 1 is an apparatus that supplies a sheet-like recording medium to the treatment liquid application apparatus 2 on the downstream side in a sheet conveyance direction. The recording medium has an image formation surface on which an image is formed in an image forming process. The recording medium fed from the sheet feeder 1 is, for example, a recording media sheet cut to a predetermined size, that is, "cut paper". Hereinafter, the present embodiment is described assuming that the recording medium is a cut sheet. The recording medium according to the present embodiment is denoted as "sheet P".

The treatment liquid application apparatus 2 includes a treatment liquid application unit 20 that coats the image formation surface of the sheet P with a treatment liquid having an effect of aggregating ink and preventing bleed-through.

The printer 3 includes an image forming unit 31 and a drying unit 32. The image forming unit 31 discharges droplets of liquid ink onto the sheet P coated with the treatment liquid in the treatment liquid application apparatus 2, thereby performing image formation. The drying unit 32 dries the treatment liquid and the ink droplets applied to the sheet P. The printer 3 includes roller pairs 33 as a conveyor to convey the sheet P. The conveyor is not limited to a roller pair but can be, for example, a conveyor belt. Further, the printer 3 includes a conveyance passage along which the sheet P is reversed from the drying unit 32 to the image forming unit 31 when printing are performed on front and back sides of the sheet P. With the reversing, an image can be formed, by ejecting ink droplets, on the back side of the image formation surface on which the image has been formed. Then, the surface on which the image is newly formed can dried in the drying unit 32, and the sheet P can be ejected to the medium ejection device 4.

The medium ejection device 4 is a device that accommodates the sheet P on which image forming processing has been performed in the printer 3.

Treatment Liquid Application Apparatus

The treatment liquid application apparatus 2 according to the present embodiment includes, in addition to the treatment liquid application unit 20 as a main part, a controller that controls the operation of the entire apparatus, a treatment liquid supply unit that is coupled to the treatment liquid application unit 20, a carrying-in unit to load the sheet P into the treatment liquid application apparatus 2, and a unloading unit to unload the sheet P coated with the treatment liquid.

The carrying-in unit and the unloading unit construct the conveyance passage with a plurality of conveyance rollers and a plurality of paper guides. In particular, the conveyance passage in the unloading unit is provided with a branch gate to switch the conveyance direction of the sheet P.

The sheet P, a recording medium in the form of a cut sheet, is fed from the sheet feeder 1 into the treatment liquid application apparatus 2 via the carrying-in unit and is conveyed along the conveyance passage to the treatment liquid application unit 20, where the treatment liquid is applied to the sheet P. Then, the sheet P is conveyed to the unloading unit along the conveyance passage and unloaded toward the printer 3. In FIG. 1, bold arrows indicate the conveyance direction of the sheet P along the conveyance passage.

Comparative Example

Figure 5:
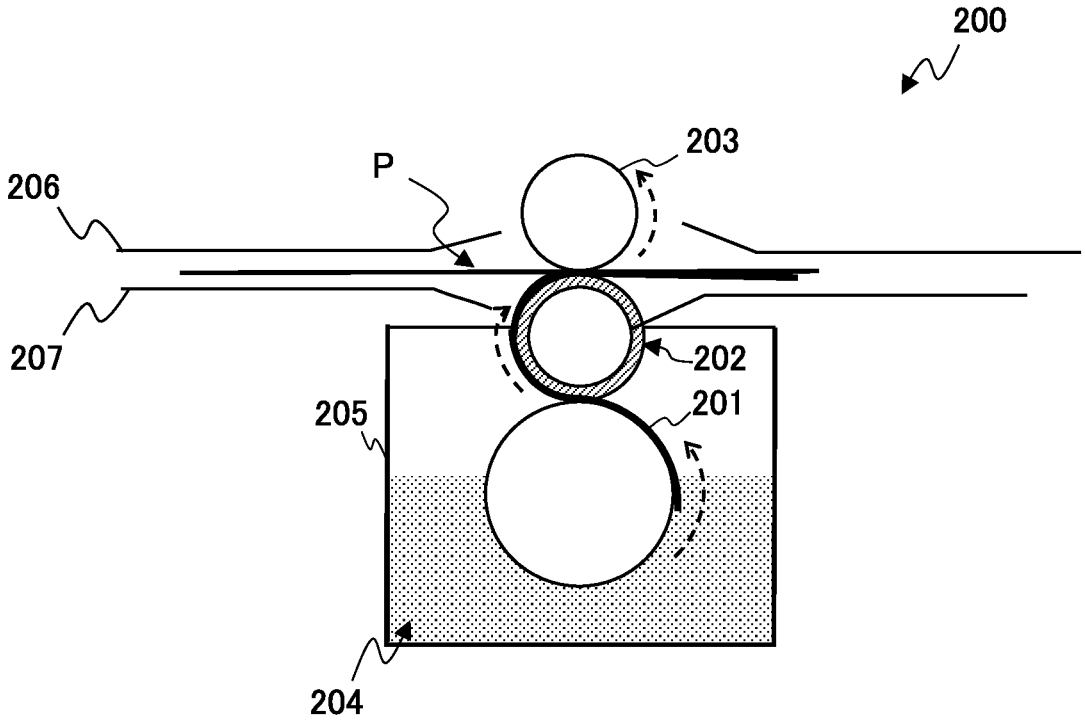
FIG. 5 is an internal view illustrating an example of an application device according to a comparative example.

A description is given of a comparative example for clarifying characteristics of the treatment liquid application unit 20 that is a main part of the treatment liquid application apparatus 2 according to the present embodiment. FIG. 5 is a schematic view illustrating a configuration of an application unit 200 as a comparative example. As illustrated in FIG. 5, in the application unit 200, a treatment liquid 204 drawn up from a supply pan 205 by a draw-up roller 201 is measured (regulated) by a nip between the draw-up roller 201 and the application roller 202 having a rubber surface layer. Then, the treatment liquid 204 is transferred to the application roller 202.

The treatment liquid 204 transferred to the application roller 202 is further transferred to a nip between the application roller 202 and a pressure roller 203 and transferred to the sheet P that has passed between an upper entry guide 206 and a lower entry guide 207.

In the application unit 200 as the comparative example, the diameter of the application roller 202 is relatively large, and the radius of curvature of the application roller 202 is relatively large. Therefore, separation of the sheet P from the application roller 202 may be difficult when the sheet P to be coated with the treatment liquid 204 has a low rigidity.

Further, if the nip force between the application roller 202 and the pressure roller 203 is excessively increased, the sheet P is likely to be creased. Then, the application roller 202 is deflected, and the amount of treatment liquid 204 is not regulated to the intended amount, which makes application of the treatment liquid uneven.

Further, even if the diameter of the draw-up roller 201 is increased to inhibit the deflection of the application roller 202, there remains the following inconvenience. The treatment liquid 204 may scatter up to the sheet P because the nip between the draw-up roller 201 and the application roller 202 is close to the sheet P conveyed.

The treatment liquid application unit 20 according to the present embodiment described below can solve the above-described inconveniences and prevent uneven application of the treatment liquid to the sheet P.

Treatment Liquid Application Unit

Figure 2:
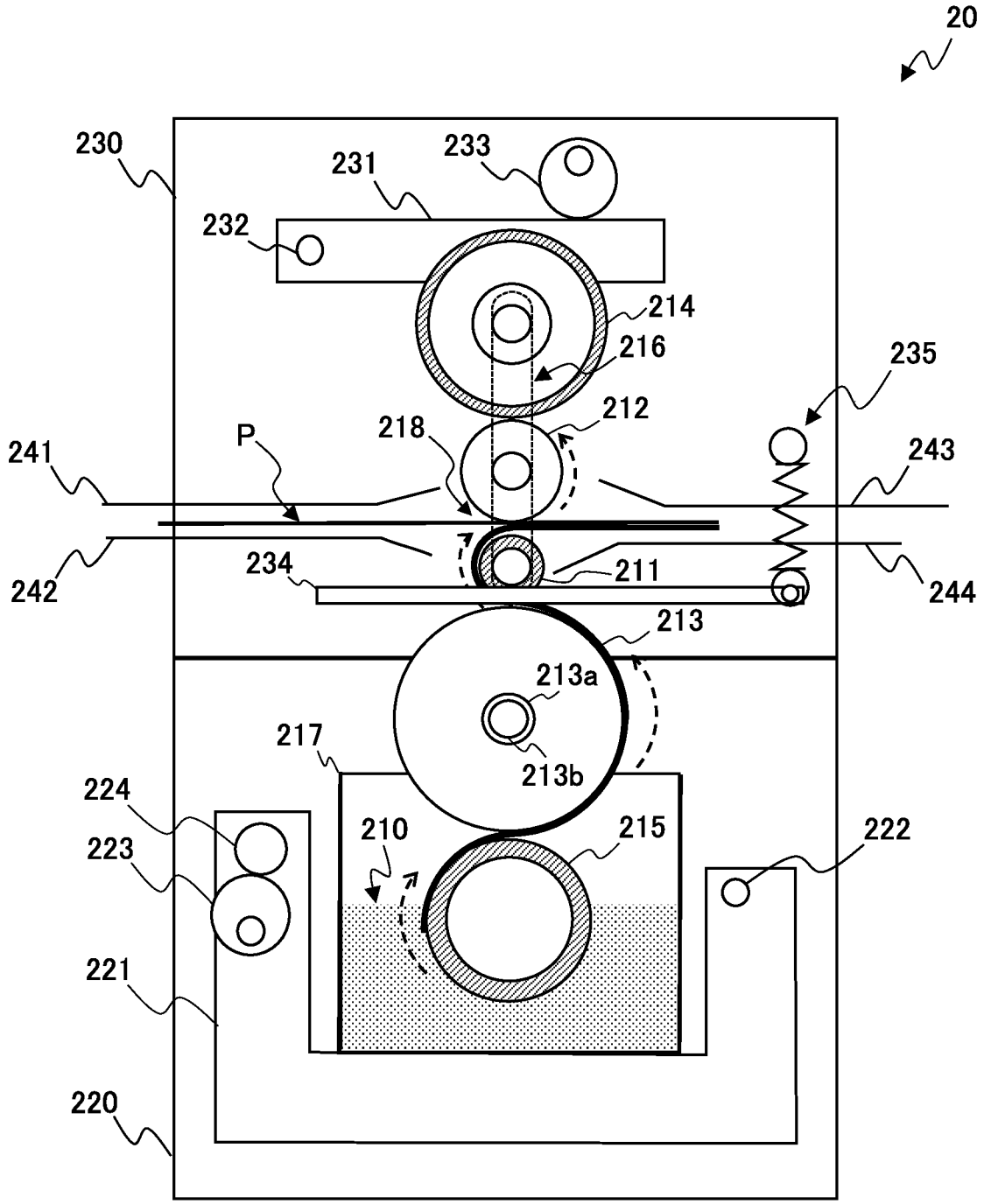
FIG. 2 is an internal view of a treatment liquid application device according to an embodiment of the present disclosure.

Next, a description is given of the treatment liquid application unit 20, with reference to the schematic view of FIG. 2. As illustrated in FIG. 2, the treatment liquid application unit 20 includes a plurality of rollers. Each roller is held so that the shaft thereof rotates in a housing of the treatment liquid application apparatus 2. The axes of the plurality of rollers are substantially parallel to each other.

The treatment liquid application unit 20 includes an application roller 211 as a first roller, a pressure roller 212 as a second roller, a measuring roller 213 as a third roller, a pressurization roller 214 as a fourth roller, and a draw-up roller 215 as a fifth roller. The measuring roller 213 has a higher rigidity than that of the application roller 211 and is disposed between the draw-up roller 215 and the application roller 211. The pressurization roller 214 has a higher rigidity than that of the pressure roller 212 and is disposed on the outer side (upper side in FIG. 2) than the pressure roller 212.

The treatment liquid application unit 20 includes a lower case 220 and an upper case 230 that secure or hold the components of the treatment liquid application unit 20.

On the lower case 220, a supply pan 217 that is a liquid container to store the treatment liquid 210 to be supplied, a lower pressure arm 221, a lower fulcrum shaft 222, a lower cam follower 224, and a lower cam 223 are disposed.

The supply pan 217 is held so as to be rotated by the lower fulcrum shaft 222, and both ends of the lower fulcrum shaft 222 are supported by the lower case 220. As the supply pan 217 is rotated by the lower fulcrum shaft 222, the rotation shaft of the draw-up roller 215 is rotated similarly.

The draw-up roller 215 is rotatably held in a state immersed in the treatment liquid 210 stored in the supply pan 217. When the draw-up roller 215 rotates, the treatment liquid 210 adhering to the surface of the draw-up roller 215 moves upward. Alternatively, the measuring roller 213 can be disposed to be immersed in the treatment liquid 210 stored in the supply pan 217, so that the measuring roller 213 doubles as a draw-up roller.

The draw-up roller 215 and the measuring roller 213 are in contact with each other. As the measuring roller 213 rotates following the rotation of the draw-up roller 215, the treatment liquid 210 drawn up by the draw-up roller 215 moves to the surface of the measuring roller 213. The measuring roller 213 is rotatably supported by the lower case 220. The measuring roller 213 and the draw-up roller 215 are pressed against each other with a predetermined pressure. This pressure is adjusted by the rotation of the supply pan 217. That is, the amount of contact between the draw-up roller 215 and the measuring roller 213 can be adjusted between the pressure contact state and the separation state by the rotation of the supply pan 217. Thus, the amount of the treatment liquid 210 that moves to the measuring roller 213 can be adjusted, and the measuring roller 213 can measure an appropriate amount of the treatment liquid 210 to be transferred to the application roller 211.

A rotation shaft 213*b* of the measuring roller 213 is inserted into a bearing 213*a* supported by the lower case 220. The bearing 213*a* secures the rotation shaft 213*b* of the measuring roller 213 not to move in the direction along the surface of the paper on which FIG. 2 is drawn. Therefore, the measuring roller 213 can move only in the rotation direction about the rotation shaft 213*b*.

The lower pressure arm 221 urges the draw-up roller 215 toward the measuring roller 213. An upper pressure arm 231 urges downward respective shafts of the application roller 211, the pressure roller 212, and the pressurization roller 214 along a guide groove 216 having a guide shape. Positions of the above-mentioned rollers except the measuring roller 213 are fixed, and the rollers are urged toward the measuring roller 213 made of metal having a high rigidity. With this configuration, the positions of the rollers can be determined with high accuracy.

An upper entry guide 241, a lower entry guide 242, an upper exit guide 243, and a lower exit guide 244 that construct a part of the conveyance passage of the sheet P are disposed in the upper case 230. The sheet P is conveyed through the gap between the upper entry guide 241 and the lower entry guide 242 and passes through a nip 218 (a conveyance nip) between the application roller 211 and the pressure roller 212. The sheet P is further conveyed through the gap between the upper exit guide 243 and the lower exit guide 244. That is, the nip 218 is where the application roller 211 contacts the pressure roller 212.

On the upper case 230, the upper pressure arm 231, an upper fulcrum 232, and an upper cam 233 are disposed.

The upper case 230 is provided with the guide groove 216, a separation arm 234, and a spring 235.

The application roller 211, the pressure roller 212, and the pressurization roller 214 are rotatably supported by the upper case 230. The guide groove 216 is formed in the upper case 230. The respective rotation shafts of the application roller 211, the pressure roller 212, and the pressurization roller 214 are held to be movable along the guide groove 216 in the vertical direction (direction to approach and move away from the supply pan 217).

The upper cam 233 contacts and draws away from the upper pressure arm 231 by rotation. As the upper cam 233 rotates, the upper pressure arm 231 is displaced in the direction to press the pressurization roller 214 against the pressure roller 212. That is, the rotation of the upper cam 233 causes the pressurization roller 214 to press the pressure roller 212.

When the upper cam 233 is separated from the upper pressure arm 231, the application roller 211 is kept separated from the measuring roller 213 by the separation arm 234 and the spring 235.

When the upper cam 233 rotates and reaches the vicinity of the top dead center, the upper cam 233 presses down the upper pressure arm 231. Then, the upper pressure arm 231 presses both ends of the pressurization roller 214 (the rotation shaft supported by the guide groove 216). As a result, the pressurization roller 214 is pressed against the pressure roller 212. Being pressed by the pressurization roller 214, the pressure roller 212 moves down along the guide groove 216 and forms the nip 218 with the application roller 211.

A first end of the separation arm 234 is fixed as a fulcrum, and a second end is biased by the spring 235. The spring 235 applies an urging force to move upward to the second end of the separation arm 234. The shaft of the application roller 211 is disposed to contact the separation arm 234. Therefore, as the upper pressure arm 231 pushes down the pressurization roller 214 to press the pressure roller 212, the pressure roller 212 forms the nip 218 with the application roller 211, and the application roller 211 presses the separation arm 234 via the nip 218. With such cooperation, the pressing force from the upper pressure arm 231 causes the separation arm 234 to move against the biasing force, and the application roller 211 contacts the measuring roller 213.

Therefore, the upper pressure arm 231 and the upper cam 233 construct a second pressing member that presses the pressure roller 212 toward the nip 218.

Next, a description is given of an operation to pass the sheet P through the treatment liquid application unit 20. When the lower cam 223 rotates and approaches the top dead center, the lower cam 223 pushes up the lower cam follower 224. The lower cam follower 224 is secured to the lower pressure arm 221. Accordingly, the rotation of the lower cam 223 pushes up the lower cam follower 224, and the lower pressure arm 221 is lifted. When the lower pressure arm 221 is lifted, the draw-up roller 215 supported by the supply pan 217 is pressed against the measuring roller 213, and the treatment liquid 210 is measured by the nip of the measuring roller 213 and becomes a thin film on the surface of the measuring roller 213.

At the same time, when the above-described lower cam 223 is positioned near the top dead center, the application roller 211 and the measuring roller 213 are pressed against each other. Then, the treatment liquid 210 is transferred from the measuring roller 213 to the application roller 211. The treatment liquid 210 that has moved to the application roller 211 is transferred onto the sheet P nipped in the nip 218 between the application roller 211 and the pressure roller 212.

Therefore, the lower cam 223, the lower cam follower 224, and the lower pressure arm 221 construct a first pressing member that presses the application roller 211, which is the first roller, toward the nip 218.

When the leading end of the sheet P exits the nip 218 between the application roller 211 and the pressure roller 212, the leading end of the sheet P is separated from the application roller 211 due to the curvature of the application roller 211 and a minute rubber deformation by the nip force. Separated from the application roller 211, the leading end of the sheet P is guided between the upper exit guide 243 and the lower exit guide 244. As a result, the sheet P can be prevented from winding around the small-diameter application roller 211.

Next, a description is given in detail of the rollers of the treatment liquid application unit 20. The sizes of the application roller 211 and the pressure roller 212 are designed to prevent winding of the sheet P having a relatively low rigidity (assuming a weight in grams per square meter of about 70 g/m$^2$). Specifically, the application roller 211 has a diameter of, for example, 30 mm or smaller, and the roller 212 has a diameter of, for example, 40 mm or smaller.

A description is given below of an attempt to uniformly apply a treatment liquid having a viscosity of 7 to 10 mPa·s to coated paper as a low-stiffness sheet P (paper weight is about 70 g/m$^2$) at 0.6 g/m$^2$, using the application roller 211 and the pressure roller 212. In this case, the deflection amount of the measuring roller 213 and the pressurization roller 214 is set to 0.1 mm or smaller.

In the present embodiment, a load (w) per unit length for applying a required amount is determined from the relation between the viscosity of the treatment liquid 210 at the measuring roller 213 and the wettability of the rubber, as "load (w)=0.66 N/mm". Further, as the specifications of the measuring roller 213, the shaft thereof is made of stainless steel, and an outer diameter D1, an inner diameter D2, a length L, and Young's modulus E thereof are set as follows.

That is, in the present embodiment, the measuring roller 213 has the outer diameter D1 of 52 mm, the inner diameter D2 of 26 mm, the length L of 640 mm, and Young's modulus E of 205800 N/mm$^2$.

According to such specifications, a maximum deflection amount δ of the measuring roller 213 is defined by Equations 1 and 2 below.

Second moment of inertia I $$= \pi/64 \times (D14 - D24) \quad \text{Equation 1}$$
$$= \pi/64 \times (524 - 264) = 336476 \ [\text{mm}^2]$$

Maximum deflection amount $\delta$ $$= 5 \times w \times L4/(384 \times E \times 1) \quad \text{Equation 2}$$
$$= 5 \times 0.66 \times 6404/(384 \times 205800 \times 336476)$$
$$= 0.021 \ [\text{mm}]$$

Further, in the present embodiment, in a case where the sheet P is thick paper, to secure separation of the sheet P from the pressurization roller 214 and prevent uneven application at the time of entering the nip 218, a load (w) per unit length is set as "load w=1.44 N/mm". In addition, as the specifications of the pressurization roller 214, the shaft thereof is made of stainless steel, and an outer diameter D1, an inner diameter D2, a length L, and Young's modulus E thereof are set as follows.

That is, in the present embodiment, the pressurization roller 214 has the outer diameter D1 of 60 mm, the inner diameter D2 of 26 mm, the length L of 640 mm, and Young's modulus E of 205800 N/mm$^2$.

According to such specifications, a maximum deflection amount δ of the pressurization roller 214 is defined by Equations 3 and 4 below.

Second moment of inertia I $$= \pi/64 \times (D14 - D24) \quad \text{Equation 3}$$
$$= \pi/64 \times (604 - 264) = 613741 \ [\text{mm}^2]$$

Maximum deflection amount $\delta$ $$= 5 \times w \times L4/(384 \times E \times I) \quad \text{Equation 4}$$
$$= 5 \times 0.66 \times 6404/(384 \times 205800 \times 613741)$$
$$= 0.011 \ [\text{mm}]$$

In the treatment liquid application unit 20 according to the present embodiment described above, the large-diameter measuring roller 213 and the large-diameter pressurization roller 214 sandwich the small-diameter application roller 211 and the small-diameter pressure roller 212. With this arrangement, the upper pressure arm 231 applies a pressing force to the pressure roller 212 via the pressurization roller 214. The contact position between the pressurization roller 214 and the pressure roller 212 is different from the position of the nip 218 at the pressure roller 212. For example, on the outer periphery of the pressure roller 212, the pressurization roller 214 contacts the pressure roller 212 at a position opposite to the nip 218 between the pressure roller 212 and the application roller 211.

The pressing force from the pressurization roller 214 causes the pressure roller 212 to form the nip 218 with the application roller 211. Via the nip 218, the pressing force is applied from the application roller 211 to the measuring roller 213. The application roller 211 contacts the measuring roller 213 at the position different from the nip 218 on the application roller 211. For example, on the outer periphery of the application roller 211, the measuring roller 213 contacts the application roller 211 at a position opposite to the position of the nip 218 between the pressure roller 212 and the application roller 211. The measuring roller 213 has a higher rigidity than that of the application roller 211, and the position of the measuring roller 213 is fixed relative to the lower case 220.

With such a configuration, the upper pressure arm 231 serving as a pressing member applies a pressing force necessary for measuring the treatment liquid 210 and separating the sheet P. Owing to the pressing force applied thereto, the application roller 211 and the pressure roller 212 having lower rigidities are sandwiched between the measuring roller 213 and the pressurization roller 214 having higher rigidities. This configuration can inhibit the deflection of the application roller 211 and the pressure roller 212 even if the diameters thereof are small.

That is, according to the present embodiment, the treatment liquid application apparatus 2 can apply the treatment liquid 210 to the sheet P while preventing winding of the sheet P around the application roller 211 and uneven application of the treatment liquid 210.

Figure 3:
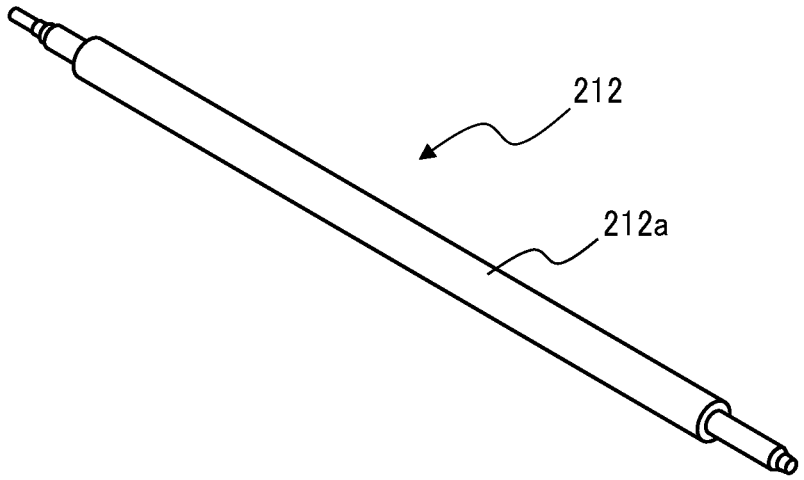
FIG. 3 is a perspective view illustrating a pressure roller in the treatment liquid application device illustrated in FIG. 2.

Next, the structure of the pressure roller 212 according to the present embodiment is described in detail. FIG. 3 is a perspective view of the pressure roller 212.

The base (shaft) of the pressure roller 212 is made of, for example, iron or stainless steel, and a roller body 212*a* of the pressure roller 212 has a surface of arithmetic average roughness (roughness average) Ra of 1.8 to 2.2. Glass beads 212*c* having a particle diameter of 80 to 120 μm are bonded to the entire area of the roller body 212*a* of the pressure roller 212 with an epoxy adhesive 212*d*.

Figure 4A:
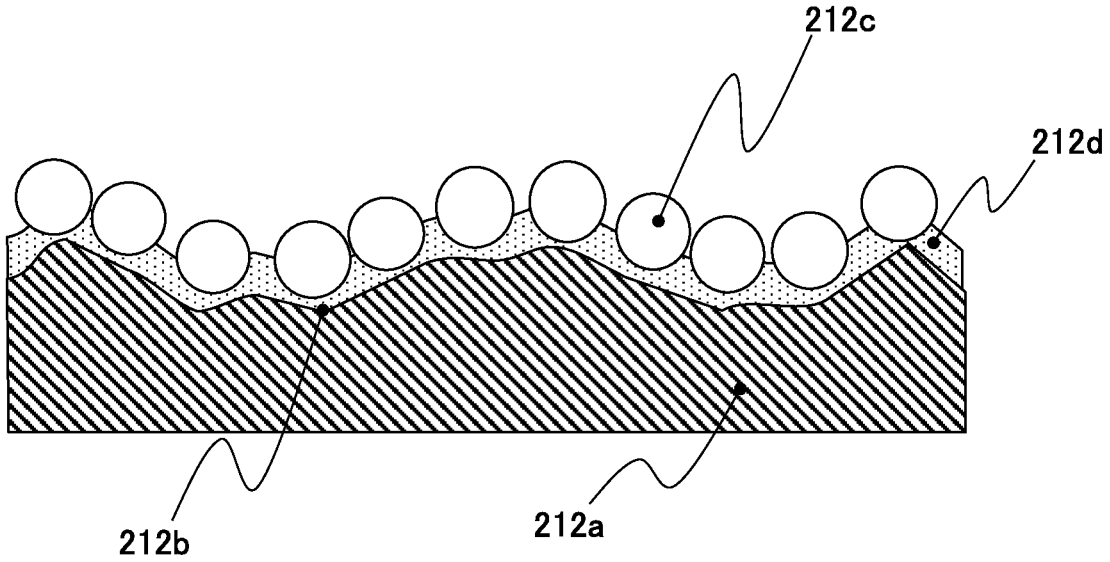
FIGS. 4A and 4B are cross-sectional views illustrating an example structure of the pressure roller illustrated in FIG. 3.
Figure 4B:
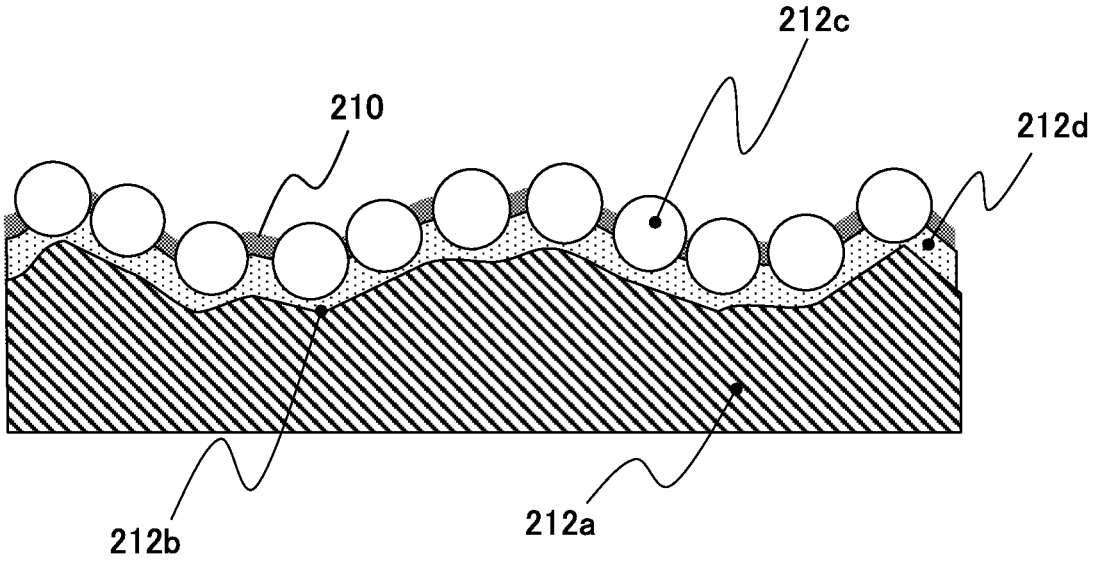

FIG. 4A is a schematic cross-sectional view illustrating the surface of the pressure roller 212. FIG. 4B is a schematic view illustrating a state where the treatment liquid 210 adheres to the surface of the pressure roller 212. As illustrated in FIG. 4A, the glass beads 212*c* are entirely bonded to a surface 212*b* of the roller body 212*a* made of rubber. The pressure roller 212 is pressed against the application roller 211 (pressure contact state) with the sheet P interposed therebetween. In such a pressure contact state, the treatment liquid 210 is transferred from the application roller 211 to the sheet P. In this case, as illustrated in FIG. 4B, the treatment liquid 210 permeates and held in recesses (gaps) between the glass beads 212*c*.

In the state where the treatment liquid 210 is held in the gaps between the glass beads 212*c* in this way, when the sheet P entering the nip 218 contacts the pressure roller 212, the amount of the treatment liquid 210 unnecessarily transferred from the pressure roller 212 to the sheet P can be reduced.

Further, the pressurization roller 214 of the present embodiment includes, as a surface layer, a rubber layer having a thickness of 1 mm to 3 mm and a hardness of 80 degrees to 90 degrees. The pressurization roller 214 is disposed to sandwich the pressure roller 212 with the application roller 211. Therefore, when the pressurization roller 214 contacts the glass beads 212*c* of the pressure roller 212, the rubber layer at the surface of the pressurization roller 214 is distorted and retracts following the glass beads 212*c*. This configuration can prevent the glass beads 212*c* from being peeled from the pressure roller 212.

With the above-described treatment liquid application apparatus 2 according to the present embodiment incorporated therein, the printing system 100 can prevent sheet jam and apply the treatment liquid 210 uniformly even when the treatment liquid 210 is applied to a recording medium in the form of a cut sheet.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An application apparatus comprising:

a liquid supply pan configured to store a treatment liquid;

a first roller configured to apply the treatment liquid to a recording medium conveyed;

a second roller disposed in contact with the first roller and forming, with the first roller, a conveyance nip in which the recording medium is nipped;

a third roller disposed in contact with the first roller at a position different from the conveyance nip, wherein the third roller is disposed in the liquid supply pan to be immersed in the treatment liquid, the third roller having a rigidity higher than a rigidity of the first roller; and a fourth roller disposed in contact with the second roller at a position different from the conveyance nip, the fourth roller having a rigidity higher than a rigidity of the second roller, wherein a diameter of the first roller is less than a diameter of the second roller.

2. The application apparatus according to claim 1, further comprising:

a first pressing member configured to press the first roller toward the conveyance nip; and a second pressing member configured to press the second roller toward the conveyance nip.

3. The application apparatus according to claim 2, wherein a deflection amount of each of the third roller and the fourth roller is 0.1 mm or smaller in a state where the first pressing member and the second pressing member press the first roller and the second roller, respectively.

4. The application apparatus according to claim 1, wherein the third roller has a larger diameter than a diameter of the first roller.

5. The application apparatus according to claim 1, wherein the fourth roller has a larger diameter than a diameter of the second roller.

6. The application apparatus according to claim 1, wherein the second roller includes glass beads bonded to a surface of the second roller.

7. The application apparatus according to claim 6, wherein the surface of the second roller is made of rubber.

8. An image forming system comprising:

an image forming apparatus configured to discharge a liquid to form an image on a recording medium while conveying the recording medium; and the application apparatus according to claim 1, to apply a treatment liquid onto the recording medium.

9. The application apparatus according to claim 1, wherein the first roller has a diameter of 30 millimeters or less.

10. The application apparatus according to claim 9, wherein the second roller has a diameter of 40 millimeters or less.

11. An application apparatus comprising:

a liquid supply pan configured to store a treatment liquid;

a first roller configured to apply the treatment liquid to a recording medium conveyed;

a second roller disposed in contact with the first roller and forming, with the first roller, a conveyance nip in which the recording medium is nipped;

a third roller disposed in contact with the first roller at a position different from the conveyance nip, the third roller having a rigidity higher than a rigidity of the first roller;

a fourth roller disposed in contact with the second roller at a position different from the conveyance nip, the fourth roller having a rigidity higher than a rigidity of the second roller; and a fifth roller disposed in the liquid supply pan to be immersed in the treatment liquid, wherein the fifth roller is in contact with the third roller, wherein the third roller has a larger diameter than a diameter of the first roller.

12. The application apparatus according to claim 11, further comprising:

a first pressing member configured to press the first roller toward the conveyance nip; and a second pressing member configured to press the second roller toward the conveyance nip.

13. The application apparatus according to claim 12, wherein a deflection amount of each of the third roller and the fourth roller is 0.1 mm or smaller in a state where the first pressing member and the second pressing member press the first roller and the second roller, respectively.

14. The application apparatus according to claim 11, wherein the second roller includes glass beads bonded to a surface of the second roller.

15. The application apparatus according to claim 14, wherein the surface of the second roller is made of rubber.

16. An image forming system comprising:

an image forming apparatus configured to discharge a liquid to form an image on a recording medium while conveying the recording medium; and the application apparatus according to claim 11, to apply a treatment liquid onto the recording medium.

17. An application apparatus comprising:

a liquid supply pan configured to store a treatment liquid;

a first roller configured to apply the treatment liquid to a recording medium conveyed;

a second roller disposed in contact with the first roller and forming, with the first roller, a conveyance nip in which the recording medium is nipped;

a third roller disposed in contact with the first roller at a position different from the conveyance nip, the third roller having a rigidity higher than a rigidity of the first roller;

a fourth roller disposed in contact with the second roller at a position different from the conveyance nip, the fourth roller having a rigidity higher than a rigidity of the second roller; and a fifth roller disposed in the liquid supply pan to be immersed in the treatment liquid, wherein the fifth roller is in contact with the third roller, wherein the fourth roller has a larger diameter than a diameter of the second roller.

* * * * *